US010821737B2

(12) United States Patent
Xing et al.

(10) Patent No.: US 10,821,737 B2
(45) Date of Patent: Nov. 3, 2020

(54) PRINTER AND PRINTER SYSTEM

(71) Applicant: Beijing Xiaomi Mobile Software Co., Ltd., Beijing (CN)

(72) Inventors: Zheng Xing, Beijing (CN); Yingchun Xie, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/565,764

(22) Filed: Sep. 10, 2019

(65) Prior Publication Data

US 2020/0164654 A1 May 28, 2020

(30) Foreign Application Priority Data

Nov. 23, 2018 (CN) ..... 2018 1 1403915

(51) Int. Cl.
*B41J 2/175* (2006.01)
*B41J 3/36* (2006.01)
(Continued)

(52) U.S. Cl.
CPC ..... *B41J 2/17523* (2013.01); *B41J 3/28* (2013.01); *B41J 3/36* (2013.01); *B41J 3/407* (2013.01); *B41J 29/38* (2013.01)

(58) Field of Classification Search
CPC ... B41J 2/17523; B41J 3/28; B41J 3/36; B41J 3/407; B41J 29/38
See application file for complete search history.

(56) References Cited

U.S. PATENT DOCUMENTS 6,116,707 A * 9/2000 Avida ..... B43L 13/024 346/139 R
9,849,693 B1 12/2017 Liu et al.
(Continued)

FOREIGN PATENT DOCUMENTS

CN 102991145 A 3/2013
CN 107933120 A 4/2018
(Continued)

OTHER PUBLICATIONS

Extended European Search Report for European Application No. 19199277.5, dated Mar. 5, 2020.
(Continued)

*Primary Examiner* — Anh T Vo
(74) *Attorney, Agent, or Firm* — Finnegan, Henderson, Farabow, Garrett & Dunner, L.L.P.

(57) ABSTRACT

A printer includes: a main body, including a bottom part adjacent to a surface to be printed and a top part opposite to the bottom part, wherein the bottom part is provided with an air inlet and an ink outlet, and the top part is provided with an air outlet; an adsorption assembly, assembled in the main body and including an air suction mechanism, wherein an air intake passage of the air suction mechanism is opened to the air inlet, and an air outlet passage of the air suction mechanism is opened to the air outlet; a printing assembly, assembled in the main body and including a main control and an ink outlet mechanism electrically connected to the main control; and a moving assembly, assembled on the bottom part of the main body and is electrically connected to the main control.

18 Claims, 5 Drawing Sheets

(51) Int. Cl.

| | |
|---|---|
| ***B41J 3/407*** | (2006.01) |
| ***B41J 29/38*** | (2006.01) |
| ***B41J 3/28*** | (2006.01) |

(56) References Cited

U.S. PATENT DOCUMENTS

| | | | | |
|---|---|---|---|---|
| 2008/0143781 | A1* | 6/2008 | Inoue | B41J 2/1714<br>347/34 |
| 2013/0328953 | A1* | 12/2013 | Jones | B41J 3/4073<br>347/9 |
| 2016/0031218 | A1* | 2/2016 | Ishida | B41J 2/1714<br>347/34 |

FOREIGN PATENT DOCUMENTS

| | | | |
|---|---|---|---|
| CN | 108724962 | A | 11/2018 |
| CN | 109278424 | A | 1/2019 |
| JP | 2005170039 | A | 6/2005 |
| JP | 2005283898 | A | 10/2005 |
| JP | 2010088058 | A | 4/2010 |
| KR | 20060056922 | A | 5/2006 |
| KR | 20110072442 | A | 6/2011 |
| RU | 2271280 | C2 | 3/2006 |
| RU | 2574525 | C2 | 2/2016 |

OTHER PUBLICATIONS

Office Action for Russian Application No. 2019127658, dated Mar. 8, 2019.

* cited by examiner

PRINTER AND PRINTER SYSTEM

CROSS-REFERENCE TO RELATED APPLICATIONS

This application is based upon and claims priority to Chinese Patent Application No. 201811403915.1, filed on Nov. 23, 2018, the entire content of which are incorporated herein by reference.

TECHNICAL FIELD

The present disclosure relates to the field of printer technology, and particularly to a printer and a printer system.

BACKGROUND

In the related art, a printer may be used to print a preset pattern on a specified wall surface. However, in order to complete printing on the entire wall surface, it is necessary to hold the printer by hand and to move it on the wall surface, or to set a moving pedrail for the printer, which increases operational complexity and structural complexity of the printer.

SUMMARY

The present disclosure provides a printer and a printer system to improve operational convenience of the printer while reducing structural complexity of the printer.

According to a first aspect of the present disclosure, a printer includes: a main body, including a bottom part adjacent to a surface to be printed and a top part opposite to the bottom part, wherein the bottom part is provided with an air inlet and an ink outlet, and the top part is provided with an air outlet; an adsorption assembly, assembled in the main body and including an air suction mechanism, wherein an air intake passage of the air suction mechanism is opened to the air inlet, and an air outlet passage of the air suction mechanism is opened to the air outlet; a printing assembly, assembled in the main body and including a main control and an ink outlet mechanism electrically connected to the main control, wherein the ink outlet mechanism is opened to the ink outlet; and a moving assembly, assembled on the bottom part of the main body and is electrically connected to the main control.

According to a second aspect of the present disclosure, a printer system includes an external control device and the above printer controlled by the external control device, wherein the external control device includes a first association module, the main control in the printing assembly includes a second association module, and the first association module is associated with the second association module to implement transmission of print data.

The technical solution provided by the embodiments of the present disclosure may include the following beneficial effects:

According to the present disclosure, by providing the adsorption assembly and the moving assembly for the printer, providing the air inlet opened to the air intake passage of the air suction mechanism at the bottom of the main body, and providing the air inlet opened to the air outlet passage of the air suction mechanism at the bottom of the main body, the printer may be adsorbed onto the surface to be printed in complicated environment, such as the horizontal plane, the vertical plane, the slope plane, or the ceiling plane, etc., by the air suction mechanism. At the same time, the surface to be printed may be printed in accordance with the planned path by cooperating of the moving mechanism provided on the bottom part of the main body and the printing assembly. Therefore, the above improvement improves adaptability to the printing environment, operation convenience and intelligence of the printer.

It shall be understood that the above general description and the following detailed description are merely exemplary and explanatory and are not intended to be restrictive of the present disclosure.

BRIEF DESCRIPTION OF THE DRAWINGS

The accompanying drawings, which are incorporated in and constitute a part of this specification, illustrate embodiments consistent with the disclosure, and together with the description, serve to explain the principle of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of devices and methods consistent with aspects related to the present disclosure as recited in the appended claims.

In the related art, effects of more and more wall surfaces are realized by printing, that is, using a printer to print a preset pattern on a designated wall surface. However, under normal circumstances, an area of the wall surface is pretty large, and circumstances of the slope and the flatness of the wall surface are complicated as well. In order to complete printing on the entire wall surface, the printer needs to be handheld to move on the wall, or a moving pedrail is set for the printer, which greatly increases operational complexity and structural complexity of the printer.

Figure 1:
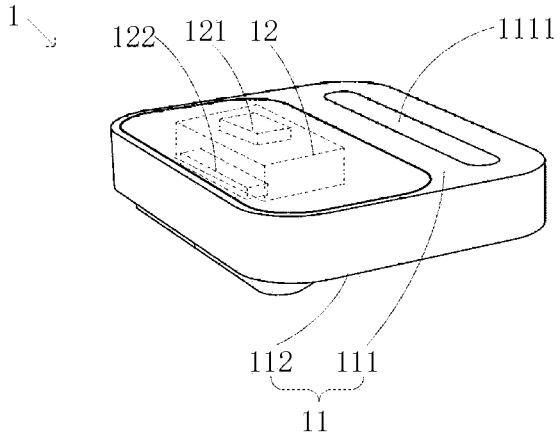
FIG. 1 is a schematic perspective view of a printer at an angle in an exemplary embodiment of the present disclosure.
Figure 2:
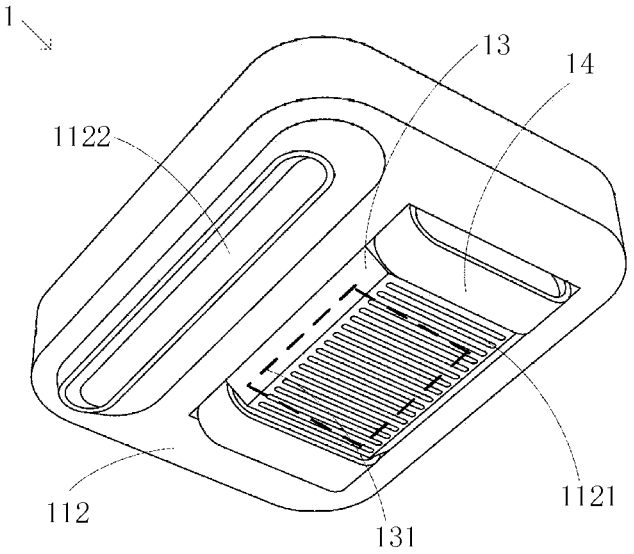
FIG. 2 is a schematic perspective view of a printer at another angle in an exemplary embodiment of the present disclosure.
Figure 3:
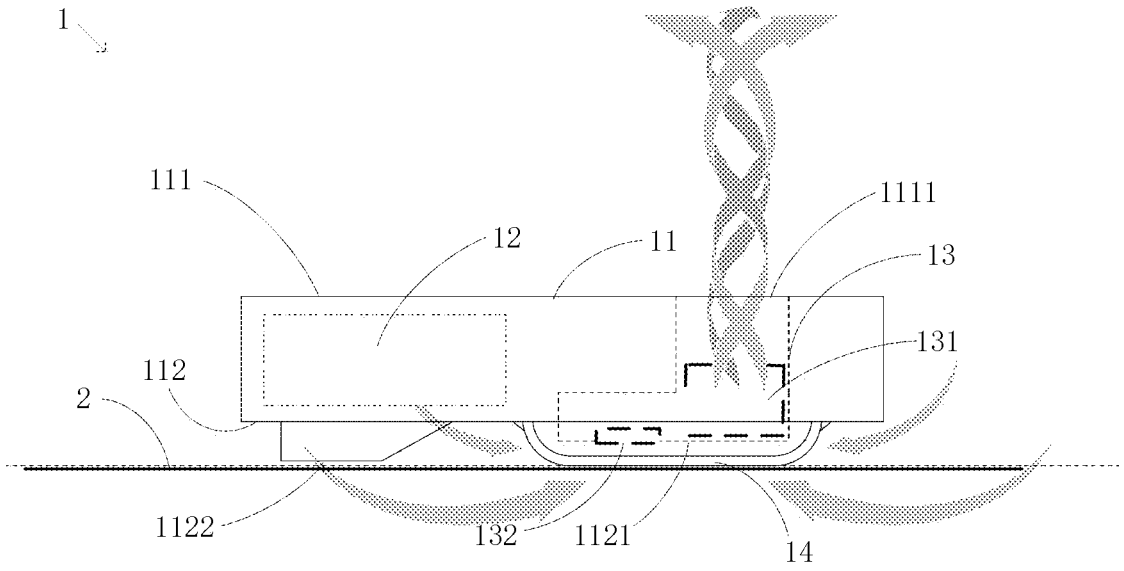
FIG. 3 is a schematic diagram of an application scene of a printer in an exemplary embodiment of the present disclosure.
Figure 5:
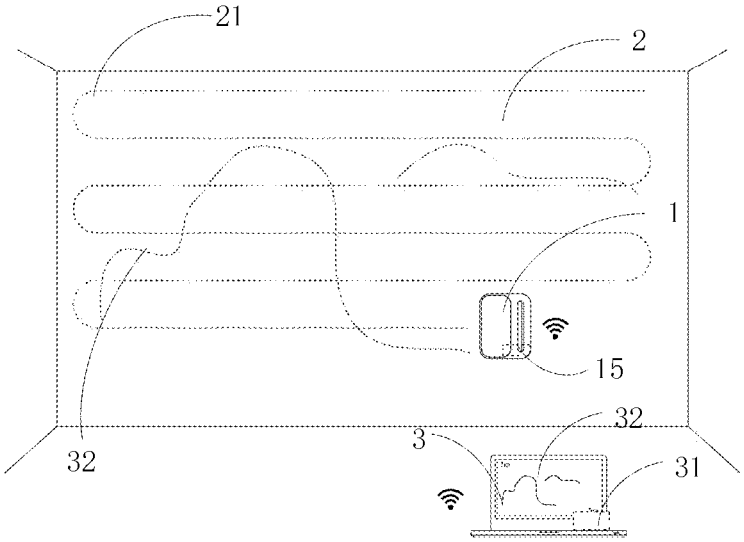
FIG. 5 is a schematic diagram of an application scene of a printer system in another exemplary embodiment of the present disclosure.

FIG. 1 is a schematic perspective view of a printer 1 at an angle in an exemplary embodiment of the present disclosure; FIG. 2 is a schematic perspective view of the printer 1 at another angle in an exemplary embodiment of the present disclosure; and FIG. 3 is a schematic diagram of an application scene of the printer 1 in an exemplary embodiment of the present disclosure. FIG. 5 is a schematic diagram of an application scene of a printer system in an exemplary embodiment of the present disclosure. Referring to FIGS. 1-3 and 5, the printer 1 includes a main body 11, an adsorption assembly 13, a printing assembly 12, and a moving assembly 14. In the embodiment, the main body 11 includes a bottom part 112 adjacent to a surface 2 to be printed and a top part 111 opposite to the bottom part 112. The bottom part 112 is provided with an air inlet 1121 and an ink outlet 1122, and the top part 111 is provided with an air outlet 1111. The printing assembly 12 is assembled in the main body 11 and includes a main control 121 and an ink outlet mechanism 122 electrically connected to the main control 121. The ink outlet mechanism 122 is opened to the ink outlet 1122 so as to be controlled to implement printing operations on the surface 2 to be printed. The moving assembly 14 is assembled on the bottom part 112 of the main body 11 and is electrically connected to the main control 121 so as to be controlled to move along a planned path 21. The adsorption assembly 13 is assembled in the main body 11 and includes an air suction mechanism 131. An air intake passage of the air suction mechanism 131 is opened to the air inlet 1121, and an air outlet passage of the air suction mechanism 131 is opened to the air outlet 1111, so as to take out air from the bottom part 112 of the printer 1, such that the printer 1 is able to be absorbed onto the surface 2 to be printed by air pressure.

Since the air suction mechanism 131 is configured to make the printer 1 to cling onto the surface 2 to be printed by air pressure, it is less influenced by environmental factors of the surface 2 to be printed. The printer 1 may be adsorbed onto the surface 2 to be printed in complicated environment, such as a horizontal plane, a vertical plane, a slope plane, or a ceiling plane, etc. At the same time, the surface 2 to be printed may be printed in accordance with the planned path 21 by cooperating of a moving mechanism provided on the bottom part 112 of the main body 11 and the printing assembly 12. Therefore, the above improvement improves adaptability to the printing environment, the operation convenience and intelligence of the printer 1.

In the above embodiments, the main control 121 can perform path planning according to actual environmental conditions of the surface 2 to be printed, and is associated with the moving assembly 14 and the ink outlet mechanism 122, to control the moving assembly 14 and the ink outlet mechanism 122 to work synchronously, thereby implement the printing of a preset graphic 32. For example, the main control 121 can perform various functions, such as analyzing a distribution of the preset graphic 32, avoiding obstacles on the surface 2 to be printed, etc., according to the area of the surface 2 to be printed, The preset graphic 32 may be pre-stored on the main control 121, or data transmission of the preset graphic 32 may be realized by the association with an external control device 3 as well, which is not limited in the present disclosure.

The following is an exemplary description of structures and assembly method of the printing assembly 12, the adsorption assembly 13, and the moving assembly 14, respectively.

1. The Adsorption Assembly 13

As shown in FIG. 1, FIG. 2, and FIG. 3, the adsorption assembly 13 includes the air suction mechanism 131 and a suction detecting mechanism 132. The air intake passage of the air suction mechanism 131 is opened to the air inlet 1121, and the air outlet passage of the air suction mechanism 131 is opened to the air outlet 1111, so as to take out the air from the bottom part 112 of the printer 1, such that the printer 1 is absorbed onto the surface 2 to be printed by air pressure. In the embodiment, the suction detecting mechanism 132 is electrically connected to the air suction mechanism 131, so as to adjust the air suction amount of the air suction mechanism 131 in accordance with the magnitude of the absorption force while detecting the suction force of the printer 1.

In an embodiment, the printer 1 operating on an uneven wall surface is taken as an example. The printer 1 moving up and down may cause an increase or decrease in the air amount at the bottom part 112 of the printer 1, that is, the adsorption force applied on the printer 1 is thus changed. When the adsorption force becomes small, information of the decrease in the adsorption force may be fed back to the air suction mechanism 131 by the suction detecting mechanism 132, so that the air suction amount of the air suction mechanism 131 is increased to increase the adsorption force. Similarly, when the adsorption force becomes large, information of the increase in the adsorption force may be fed back to the air suction mechanism 131 by the suction detecting mechanism 132, so that the air suction amount of the air suction mechanism 131 is decreased to decrease the adsorption force. Since a small adsorption force may cause that the printer 1 has a risk of falling during the working process, and a large adsorption force will form large friction between the printer 1 and the surface 2 to be printed, adjustment of the adsorption force by the suction detecting mechanism 132 improves safety of use and work efficiency of the printer 1.

In the above embodiments, the air inlet 1121 is provided at the bottom part 112 of the main body 11 and configured to cooperate with the air suction mechanism 131 to take out the air of the bottom part 112 of the printer 1. In the embodiment, the air inlet 1121 may include a plurality of strip-shaped holes arranged side by side. By the strip-shaped holes arranged side by side, external artistic appearance of the printer 1 may be improved, and the air inlet 1121 is prevented from being too large to excessively suck in excessive impurities, thereby improving working safety of the air suction mechanism 131.

It should be noted that the air suction mechanism 131 may be a turbo or other devices capable of performing an air suction function, and the present disclosure is not limited thereto. When the air suction mechanism 131 is the turbo, the turbo matching the size of the printer 1 may be selected according to the size of the printer 1 to improve utilization of the internal space of the printer 1.

2. The Moving Assembly 14

As shown in FIG. 1, FIG. 2, and FIG. 3, the moving assembly 14 may be a variety of mechanisms such as a pedrail, a roller, etc., to move on various types of surfaces to be printed, and the present disclosure is not limited thereto. When the moving assembly 14 is a pedrail, the moving assembly 14 may include at least one pedrail. The width of the pedrail matches the width of the bottom part 112 of the printer 1, and movement of the pedrail drives the printer 1 to move as a whole. Alternatively, the moving assembly 14 may include two pedrails as well, and the two pedrails are respectively arranged on both sides of the air inlet 1121, which avoids excessive occupation of the space of the bottom part 112 of the printer 1 by the pedrails, and improves stability and flexibility during the movement of the printer 1.

It should be noted that material of the pedrail may be soft rubber such as PE (polyethylene) or PP (polypropylene). The pedrail with the material of soft rubber can cushion collision that the printer 1 encounters during a moving process, so as to avoid problems of falling caused by the collision, to increase stability of the movement of the printer 1.

3. The Printing Assembly 12

Figure 4:
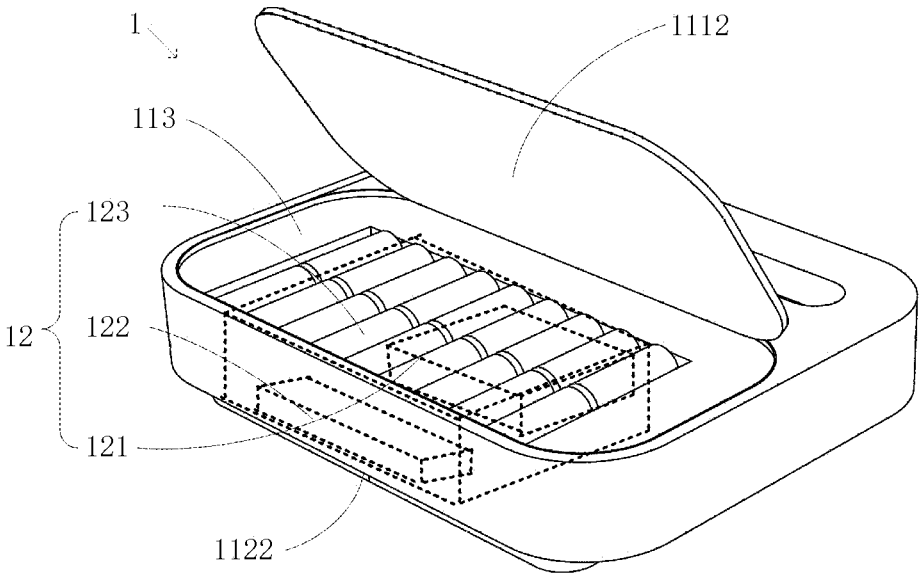
FIG. 4 is a schematic perspective view of a printer in another exemplary embodiment of the present disclosure.

In the embodiment shown in FIG. 4, the printing assembly 12 includes the main control 121, the ink outlet mechanism 122, and an ink cartridge 123. In the embodiment, the ink outlet mechanism 122 is electrically connected to the main control 121, so as to control the ink outlet mode by the main control 121 according to the graphic to be printed. Further, the ink outlet mechanism 122 is opened to the ink cartridge 123, to perform a derivation processing of ink in the ink cartridge 123. The ink cartridge 123 may be an integrated ink cartridge assembled in the printer 1, which may avoid structural interference on the movement of the printer 1 when a complicated structure such as an ink tube is adopted.

In the above embodiments, the top part 111 of the main body 11 includes an opening and a cover plate 1112 that movably cooperates with the opening, and an interior part of the main body 11 is provided with an accommodating part 113 corresponding to the opening. The ink cartridge 123 is assembled in the accommodating part 113, the disassembly and replacement of the ink cartridge 123 may be realized by opening the cover plate 1112, and the ink cartridge 123 may be encapsulated in the accommodating part 113 by closing the cover plate 1112, thereby improving the convenience of disassembly, assembly and replacement of the ink cartridge 123.

Further, the ink outlet mechanism 122 is opened to the ink outlet 1122 of the bottom part 112 of the main body 11, so that the ink may be printed on the surface 2 to be printed through the ink outlet 1122. In the embodiment, the bottom part 112 includes an edge region, and the ink outlet 1122 is arranged at the edge region. An arrangement of the ink outlet 1122 in the edge region reduces the interference of the moving mechanism and the air inlet 1121 on an ink outlet operation, thereby improving printing efficiency.

The present disclosure further provides a printer system including the printer 1, as shown in FIG. 5, which includes an external control device 3 and the printer 1. The external control device 3 includes a first association module 31. The main control 121 includes a second association module 15. The first association module 31 is associated with the second association module 15 to implement transmission of print data, which improves the convenience and control intelligence of the printer system.

The printer 1 may be adsorbed onto the surface 2 to be printed of complicated environment, such as the horizontal plane, the vertical plane, the slope plane, or the ceiling plane, etc., by the air suction mechanism 131. At the same time, the surface 2 to be printed may be printed in accordance with the planned path 21 by cooperating of the moving mechanism provided on the bottom part of the main body 11 and the printing assembly 12. Therefore, the above improvement improves the adaptability to the printing environment, the operation convenience and intelligence of the printer 1.

In the above embodiments, the first association module 31 and the second association module 15 may be managed by a wireless network, so as to avoid the influence of a connection line on the operation of the printer 1, to improve the convenience of use. A specific work process may be that the second association module 15 of the printer 1 and the first association module 31 of the external control device 3 are connected via the wireless network, plane information, graphic information, etc., of the preset graphic 32 are transmitted to the main control 121 of the printer 1 through the external control device 3, and the main control 121 forms the planned path 21 based on the received information of the preset graphic 32. A user places the printer 1 on the starting point of the surface 2 to be printed, the printer 1 starts a printing work, that is, starts to be absorbed onto the plane and to draw graphic on the plane according to the planned path 21. A reminder module electrically connected to the main control 121 may be further provided for the printer 1. After the printer 1 completes drawing the graphic according to the planning path 21, the user is reminded to remove the printer 1 by the reminder module.

It should be noted that the external control device 3 may be a mobile phone, a computer, etc., and the present disclosure is not limited thereto.

After considering this description and practicing the embodiments disclosed here, those skilled in the art may easily think of other implementation of the present disclosure. The present disclosure intends to cover any variations, usage or adaptive change of these embodiments, and these variations, usage or adaptive change follow general principle of the present disclosure and include the common knowledge or the customary technical means in the technical field that is not disclosed in the present disclosure. The description and embodiments are only exemplary, and the real range and spirit of the present disclosure are defined by the following claims.

It should be understood that the present disclosure is not limited to precise structures that are described above and shown in the accompanying drawings, and may be modified and changed variously without departing from the range of the present disclosure. The scope of the present disclosure is only defined by the appended claims.

What is claimed is:

1. A printer, comprising:

a main body, comprising a bottom part adjacent to a surface to be printed and a top part opposite to the bottom part, wherein the bottom part is provided with an air inlet and an ink outlet, and the top part is provided with an air outlet;

an adsorption assembly, assembled in the main body and comprising an air suction mechanism, wherein an air intake passage of the air suction mechanism is opened to the air inlet, and an air outlet passage of the air suction mechanism is opened to the air outlet;

a printing assembly, assembled in the main body and comprising a main control and an ink outlet mechanism electrically connected to the main control, wherein the ink outlet mechanism is opened to the ink outlet; and a moving assembly, assembled on the bottom part of the main body and is electrically connected to the main control.

2. The printer according to claim 1, wherein the top part of the main body comprises an opening and a cover plate that movably cooperates with the opening, an interior part of the main body is provided with an accommodating part corresponding to the opening, the printing assembly further comprises an ink cartridge opened to the ink outlet mechanism, and the ink cartridge is assembled in the accommodating part.

3. The printer according to claim 1, wherein the adsorption assembly further comprises a suction detecting mechanism electrically connected to the air suction mechanism.

4. The printer according to claim 1, wherein the bottom part comprises an edge region, and the ink outlet is arranged at the edge region.

5. The printer according to claim 1, wherein the air inlet comprises a plurality of strip-shaped holes arranged side by side.

6. The printer according to claim 1, wherein the air suction mechanism comprises a turbo.

7. The printer according to claim 1, wherein the moving assembly comprises at least one pedrail.

8. The printer according to claim 7, wherein the moving assembly comprises two pedrails respectively arranged on both sides of the air inlet.

9. The printer according to claim 7, wherein material of the pedrail comprises soft rubber.

10. A printer system, comprising:

an external control device; and a printer controlled by the external control device, wherein the printer comprises:

a main body, comprising a bottom part adjacent to a surface to be printed and a top part opposite to the bottom part, wherein the bottom part is provided with an air inlet and an ink outlet, and the top part is provided with an air outlet;

an adsorption assembly, assembled in the main body and comprising an air suction mechanism, wherein an air intake passage of the air suction mechanism is opened to the air inlet, and an air outlet passage of the air suction mechanism is opened to the air outlet;

a printing assembly, assembled in the main body and comprising a main control and an ink outlet mechanism electrically connected to the main control, wherein the ink outlet mechanism is opened to the ink outlet; and a moving assembly, assembled on the bottom part of the main body and is electrically connected to the main control; and wherein the external control device comprises a first association module, the main control in the printing assembly comprises a second association module, and the first association module is associated with the second association module to implement transmission of print data.

11. The printer system according to claim 10, wherein the top part of the main body comprises an opening and a cover plate that movably cooperates with the opening, an interior part of the main body is provided with an accommodating part corresponding to the opening, the printing assembly further comprises an ink cartridge opened to the ink outlet mechanism, and the ink cartridge is assembled in the accommodating part.

12. The printer system according to claim 10, wherein the adsorption assembly further comprises a suction detecting mechanism electrically connected to the air suction mechanism.

13. The printer system according to claim 10, wherein the bottom part comprises an edge region, and the ink outlet is arranged at the edge region.

14. The printer system according to claim 10, wherein the air inlet comprises a plurality of strip-shaped holes arranged side by side.

15. The printer system according to claim 10, wherein the air suction mechanism comprises a turbo.

16. The printer system according to claim 10, wherein the moving assembly comprises at least one pedrail.

17. The printer system according to claim 16, wherein the moving assembly comprises two pedrails respectively arranged on both sides of the air inlet.

18. The printer system according to claim 16, wherein material of the pedrail comprises soft rubber.

* * * * *